United States Patent [19]

Rauser et al.

[11] 3,994,686

[45] Nov. 30, 1976

[54] HELICAL BIFILAR WOUND ULTRA-VIOLET STERILIZATION FOR TUBE SHAPED MATERIAL

[75] Inventors: Jan Axel Ingemar Rausér; Irma Marita Rausér, both of Lomma, Sweden

[73] Assignee: AB Ziristor, Lund, Sweden

[22] Filed: Mar. 11, 1975

[21] Appl. No.: 557,322

[30] Foreign Application Priority Data

Mar. 11, 1974 Sweden ..... 7403181

[52] U.S. Cl. ..... 21/102 R; 21/54 R; 21/DIG. 2; 53/28; 250/504; 426/414; 426/240; 426/248

[51] Int. Cl.[2] ..... A61L 3/00; B65B 55/08

[58] Field of Search..... 21/2, 54 R, 102 R, DIG. 2; 250/503, 504; 313/110, 112, 113; 426/399, 107, 240, 248, 414; 53/28, 167; 99/451

[56] References Cited

UNITED STATES PATENTS

| | | | |
|---|---|---|---|
| 2,810,652 | 10/1957 | Armbruster | 53/28 X |
| 3,063,845 | 11/1962 | Graves | 426/399 X |
| 3,466,850 | 9/1969 | Hudson et al. | 21/102 R X |
| 3,911,642 | 10/1975 | Ernstsson | 21/56 |

*Primary Examiner*—Norman Yudkoff
*Assistant Examiner*—Dale Lovercheck
*Attorney, Agent, or Firm*—Earle R. Marden; H. William Petry

[57] ABSTRACT

Apparatus for the sterilization of a tube of packages which employs a stationary source of ultra-violet rays inside the tube of material which has a cross-sectional shape substantially the same as that of the tube.

3 Claims, 1 Drawing Figure

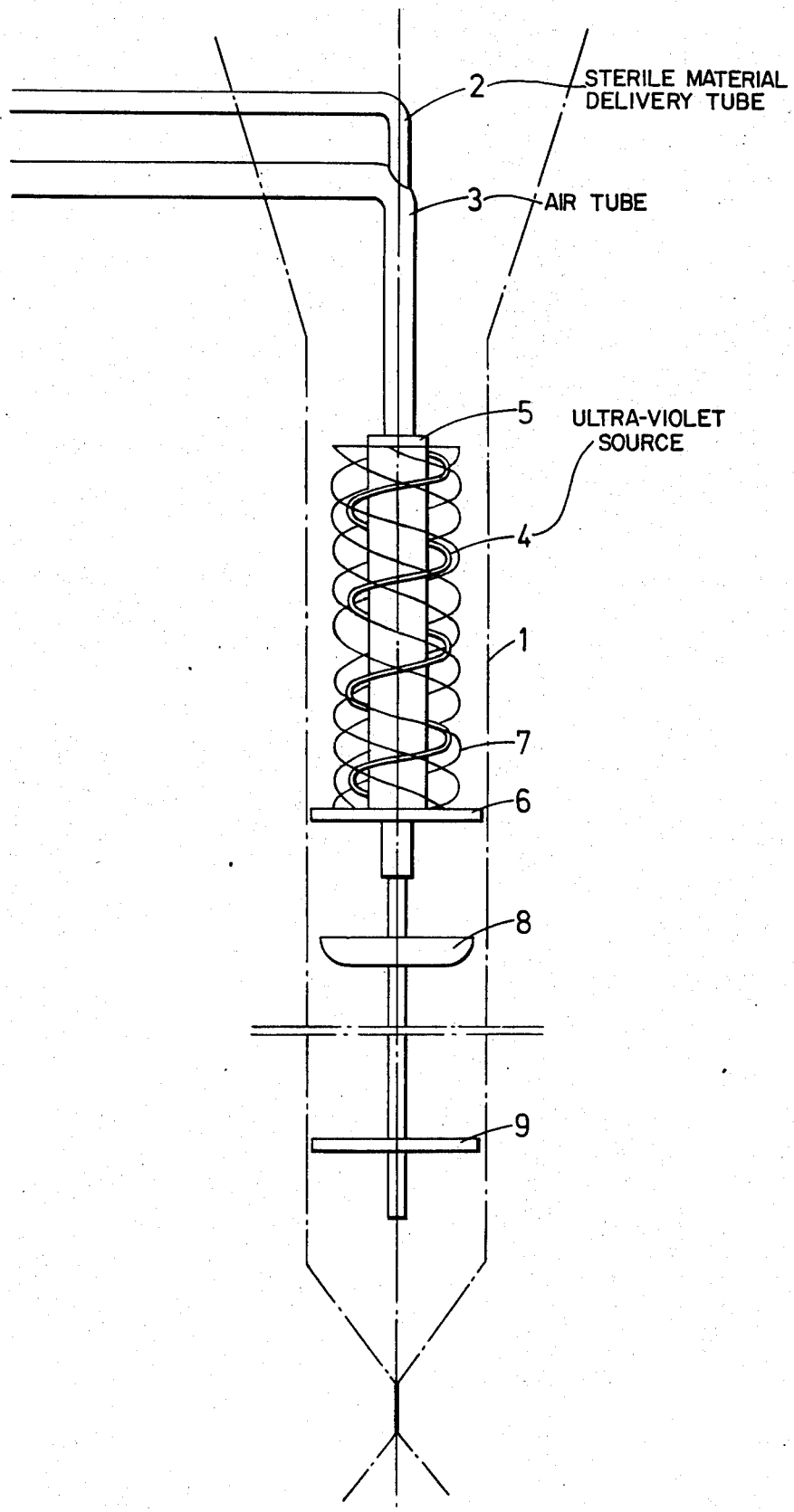
2
STERILE MATERIAL DELIVERY TUBE
3
AIR TUBE
5
ULTRA-VIOLET SOURCE
4
1
7
6
8
9

HELICAL BIFILAR WOUND ULTRA-VIOLET STERILIZATION FOR TUBE SHAPED MATERIAL

The present invention relates to an arrangement for the sterilization of a web of packing material shaped to a tube and passing continuously through a packing machine.

The arrangement in accordance with the invention is intended to be used in the type of packing machines which continuously manufacture aseptic, separate packages filled, e.g. with sterile milk, from a web of packing material passing through the packing machine. In this type of packing machines the necessary sterilization of the inside of the packages has been achieved previously by allowing the packing material to pass through a bath of hydrogen peroxide and thereafter heating the material web to approximately 110° C by means of infrared heating. To obtain the desired degree of sterilization, a heating time of 2 – 5 seconds is required which, owing to the relatively rapid movement of the packing material through the machine, makes necessary a long radiation zone. The high temperature may cause the material web easily to catch fire, if its rate of transport through the machine is lowered or its movement is stopped altogether. Even at the normal rate of transport the heating of the material causes the same to become brittle and difficult to seal, and the moisture contained in the paper which is transformed to steam has a detrimental effect on the durability and tightness of the longitudinal joint. Finally, the high working temperature means that the whole machine is heated up, which causes thermal stresses and packing problems.

It is an object of the present invention to overcome the abovementioned disadvantages and to provide a sterilization arrangement for a continuously moving material tube, which arrangement, even at high tube speeds, effectively and without inconveniences sterilizes the inside of the tube.

This and other objects have been achieved in accordance with the invention, in that an arrangement of the type described in the introduction was given the characteristic that a stationary source of ultra-violet rays is arranged inside the tube of packing material and has an outer contour corresponding to the cross-sectional shape of the tube, and that the source of ultra-violet rays is arranged so in the tube that all the parts of the inside of tube are substantially uniformly irradiated.

In the following description, the invention will be described in detail with reference to the enclosed DRAWING, which schematically shows the sterilization arrangement in accordance with the invention as it is installed in a packing machine. The tube of packing material surrounding the sterilization equipment is indicated by dash-dotted lines for the sake of greater clearness.

It is evident from the drawing that the sterilization arrangement in accordance with the invention is arranged inside a tubular part 1 of a web of packing material, which tubular part extends from the growth end of the tube 1 (on top in the drawing) and to the place at which the tube is filled with contents (for example sterile milk) and is converted to individual packages (at the bottom in the drawing). The sterilization arrangement is thus fixed and is carried by a delivery tube 2 for the contents, which tube extends substantially horizontally into the tube above the growth end of the latter and thereafter vertically downwards through the tube and substantially co-axially with the same until the region for the conversion of the tube to individual packages. The delivery tube 2 is surrounded co-axially by another tube 3, which delivers air to the region below the sterilization arrangement and whose function will be described in detail in the following. The sterilization arrangement itself comprises a source of ultra-violet radiation 4, which helically surrounds the two co-axial tubes 2 and 3. Between the air delivery tube 3 and the source of ultra-violet rays 4 a reflector 5 is present which is substantially cylindrical and at its lower end is provided with a flange 6, which has a shape corresponding to the cross-sectional shape of the tube, and which has a narrow gap between its outside periphery and the inside of the tube. The gap has a width of between 1 – 5 mm. The sterilization arrangement is protected by a basket-like protective envelope 7 which is of such a nature that it does not appreciably hinder the radiation towards the inside of the tube. Directly below the sterilization arrangement a screen 8 is placed at the outlet of the tube 3, which is adapted so as to reverse the direction of the air flowing out of the tube 3. Finally, a flange 9 is present in the vicinity of the outlet of the filling tube 2, which is adapted so as to prevent the contents during operation from splashing upwards towards the sterilization arrangement.

In the manufacture of aseptic packages, e.g. for milk, by means of a packing machine of the present type, the packing material is shaped in conventional manner to tubular form, whereupon it is allowed to pass, at its normal speed of movement, the sterilization arrangement in accordance with the invention which is arranged stationary inside the movable tube. The inside of the tube 1 is illuminated continuously by the source of ultra-violet rays 4 which is arranged so in the tube that all the parts of the tube's inside are irradiated uniformly. This is facilitated by the ultra-violet radiation source 4 having an outer contour corresponding to the cross-sectional shape of the tube, and by the reflector 5 being arranged inside the source of ultra-violet rays, by virtue of which the bulk of the radiation is reflected outwards towards the inner wall of the tube. The source of ultra-violet rays can also be wound "bifilar", which means that the tube constituting the source of ultra-violet rays is folded double and is helically wound, so that both ends of the tube are situated adjacent one another. The effective length of the winding (in the direction of movement of the tube) is chosen so that each point of the tube is irradiated during 0.5 – 2 seconds. The source of ultra-violet rays is a low-pressure mercury vapour lamp of known type and the wavelength of the radiation is preferably 2537 A.

The reflector 5 arranged inside the source of ultra-violet rays is manufactured of a suitable, ultra-violet radiation reflecting material, for example anodized aluminum, which has a reflection factor for ultra-violet radiation of 0.9. The reflector contributes to a concentration of the radiation towards the inside of the tube, as a result of which high radiation density can be achieved by simple means.

For the purpose of preventing the contents, which are always present in the bottom end of the tube from being subjected to radiation, the reflector 5 is provided at its bottom end with the flange 6 which extends outwards towards the inside wall of the tube and whose peripheral region is at a distance of between 1 – 5 mm. from the inside wall of the tube. In this way it is effectively prevented that ultra-violet radiation from the source of ultra-violet rays 4 present above the flange can reach the lower end of the tube 1.

In the operation of the machine a certain formation of ozone occurs owing to the ultra-violet radiation, and since ozone has a negative effect on for example milk, it is desirable to remove the ozone, or in any case prevent it from reaching the contents. This is achieved in that air is introduced into the tube 1 above the product level, which is done by means of the tube 3, which as mentioned earlier co-axially surrounds a part of the filling tube 2 and ends below the radiation region. To guide the air upwards through the material tube 1, the screen 8 is arranged around the filling tube 2 below the outlet of the tube 3, as a result of which the outflowing air is made to flow upwards through the tube, that is to say between the flange 6 of the reflector 5 and the wall of the tube 1, past the source of radiation and the irradiation region, the ozone being entrained and flowing out together with the air at the upper, open end of the tube. By this, a constant air stream upwards through the tube is generated, which effectively prevents the ozone from reaching the product level.

To protect the relatively delicate source of ultra-violet 4 against mechanical damage, the radiation source is surrounded by the envelope 7 which may be manufactured of metal wire or the like. It is important here that no wires run parallel with the direction of movement of the tube, since this would obviously mean that certain parts of the inner surface of the tube, at the passing of the radiation source, would never be exposed to ultra-violet radiation and thus would not be sterilized. Bearing this in mind, it will be appropriate to design the protective envelope of a helical wire with opposite pitch in relation to the likewise helical radiation source. The protective envelope moreover comprises further metal wires fixed to the helical wire, which run helically in opposite direction with very steep pitch (almost vertically) so that they too cannot form any shadow portion of substantially longitudinal extension on the inner surface of the tube. The protective envelope 7 rests on the bottom flange 6 of the reflector 5 and is attached moreover at the upper end of the reflector.

It is suitable in certain cases to let the tube 3 constitute the reflector. In this case of course the flange 6 is arranged directly on the tube 3, and the protective envelope is fixed to the tube 3 instead of to the reflector 5.

By means of the invention a sterilization arrangement is provided which makes possible a cold sterilization of the inner surface in a tube of packing material passing through a packing machine. The sterilization arrangement operates effectively and quickly and does not make necessary any reduction in the normal operating speed of the packing machine. Moreover only an insignificant rise in temperature of the packing material and of the machine arises, as a result of which the difficult problems mentioned earlier, which are associated with the high working temperature of earlier sterilization arrangements, are overcome. Finally, no chemicals are used for the sterilization, so that there is no danger of chemicals being mixed into the contents.

Although the specific embodiments of the invention have been described, it is contemplated that changes may be made without departing from the scope or spirit of the invention and it is desired that the invention be limited only by the scope of the claims.

That which is claimed is:

1. Apparatus for sterilization of a web of tube shaped material in a machine producing individual packages comprising: a filling tube means to supply a sterilized product into the tube shaped material through a bottom opening, a bifilar helical wound source of ultra-violet rays surrounding said filling tube means to supply a sterilized product and having a diameter less than the diameter of the tube shaped material, means to supply sterilized air into the tube shaped material surrounding said filling tube means inside said source of ultra-violet rays, said means to supply sterilized air opening above a deflector means, said deflector means surrounding said filling tube means between said means to supply sterilized air and the bottom opening of said filling tube means to deflect sterilized air upwards.

2. The apparatus of claim 1 wherein an ultra-violet ray reflector is mounted inside said source and outside said means to supply sterilized air to reflect the ultra-violet rays from said source.

3. The apparatus of claim 2 wherein a splash plate is located on said filling tube means adjacent the end thereof to prevent product from said filling tube means from splashing upwards.

* * * * *